United States Patent [19]

Kohmoto et al.

[11] Patent Number: 4,684,235

[45] Date of Patent: Aug. 4, 1987

[54] IMAGE FORMING APPARATUS

[75] Inventors: Yujiro Kohmoto, Hyogo; Yoshihiro Tanimoto, Himeji, both of Japan

[73] Assignee: Sanyo Electric Co., Ltd., Japan

[21] Appl. No.: 799,440

[22] Filed: Nov. 19, 1985

[30] Foreign Application Priority Data

Nov. 27, 1984 [JP] Japan ..... 59-249847

[51] Int. Cl.[4] ..... G03G 15/00

[52] U.S. Cl. ..... 355/3 R; 355/14 R; 355/3 SH; 355/14 SH; 355/21

[58] Field of Search ..... 355/3 R, 14 R, 21, 3 SH, 355/14 SH

[56] References Cited

U.S. PATENT DOCUMENTS

| | | | |
|---|---|---|---|
| 3,997,262 | 12/1976 | Doi et al. | 355/3 R X |
| 4,176,941 | 12/1979 | Breitenkam et al. | 355/3 SH X |
| 4,465,359 | 8/1984 | Nakahata | 355/3 R |
| 4,575,223 | 3/1986 | Shimono et al. | 355/3 R X |

*Primary Examiner*—A. C. Prescott

*Attorney, Agent, or Firm*—Darby & Darby

[57] ABSTRACT

An image forming apparatus such as an electronic copier and the like, particularly constructed such that the apparatus can be raised to a right angle from the posture in the normal operation for removing a jammed paper through the exposed bottom thereof or for carrying is disclosed. The apparatus comprises a sensor for sensing whether the apparatus is in posture for the normal image forming operation or not and a means for stopping the image forming operation when the apparatus is not in posture for the normal image forming operation. Such problems that the parts of the apparatus may be out of order, the original support plate may be damaged and the like by accidental operation when the apparatus is raised to a right angle from the posture in normal operation for removing a jammed paper and the like are eliminated.

14 Claims, 11 Drawing Figures

IMAGE FORMING APPARATUS

BACKGROUND OF THE INVENTION

1. Field of the Invention

The present invention relates to an image forming apparatus such as an electrostatic or magnetic recording apparatus and the like for use in electronic copies, printers, facsmiles and so forth and, more particularly, to an image forming apparatus which can be raised to an angle of 90 degrees irom the posture in the normal operation for removing a recording paper, when jammed, out of the apparatus, or carrying the apparatus by hand.

2. Description of the Prior Art

Conventional types of image forming apparatus such as an electronic copier and so forth are generally large in size and heavy due to the contained high-voltage equipments. For normal operation, the apparatuses are installed on a special platform or a floor. The apparatus once installed seldom took any position different from that of the apparatus in normal use.

Recently image forming apparatuses compactly designed and lightweighted enough to be carried even by one person have been developed and practically used. Japan Patent Appln. Laid-Open No. 56-11474(1981) discloses an apparatus having a handle mounted on the side wall thereof whereby a user can grip the handle to raise the apparatus to an angle of 90 degrees from the posture in the normal operation and further to carry the apparatus. Most of the apparatuses having such construction are longer in some degree in the horizontal direction than in the vertical direction when placed for normal operation. Accordingly, the apparatus is advantageously placed on a iloor, a desk or the like with the handle positioned into the upper face of the apparatus. Though such placement is convenient and advantageous, the apparatus is in danger that the original support plate, particularly if it is of movable type, is damaged, and that a person near the apparatus is injured and so forth when the operation switch is accidently touched and input by fingers and the like. Japan patent Application No. 59-172911(1984, U.S. patent application Ser. No. 750,878) by the present inventors discloses an image forming apparatus having an opening disposed at the bottom thereof. When a recording paper is jammed, the apparatus is raised to an angle of 90 degrees from the posture in the normal operation so the jammed paper can be taken out of the body through the exposed opening with ease. There is, however, a large possibility of the operation switch to be touched and input by a person's hand and the like when a jammed recording paper is taken out of the body.

Conventional image forming apparatus recognize such problems that if the apparatus operates in a position different from that of in the normal operation, the apparatus may be out of order, the recording papers may be wasted and so forth, due to the movement of the recording papers or falling by gravitation of the toner when used in the apparatus.

OBJECT OF THE INVENTION

In view of the above described problems, an object of the present invention is to provide an image forming apparatus which is prevented from starting of the copying operation when the apparatus is in a position different from that of the apparatus in the normal use.

Another object of the present invention is to provide an image forming apparatus capable of utilizing such a means for sensing a jammed paper as used in a conventional type of image forming apparatus without need of an additional sensing means for achieving the above said object of this invention.

A further object of the present invention is to provide an image forming apparatus capable of sensing easily and securely the position of the image forming apparatus without need of use of a complicated and expensive sensor.

The above and further objects and features of the invention will more fully be apparent from the following detailed description with reference to the accompanying drawings.

DETAILED DESCRIPTION OF THE INVENTION

Hereinafter, explanation will be given on an embodiment of the image forming apparatus of the invention applied to an electronic copier.

Figure 1:
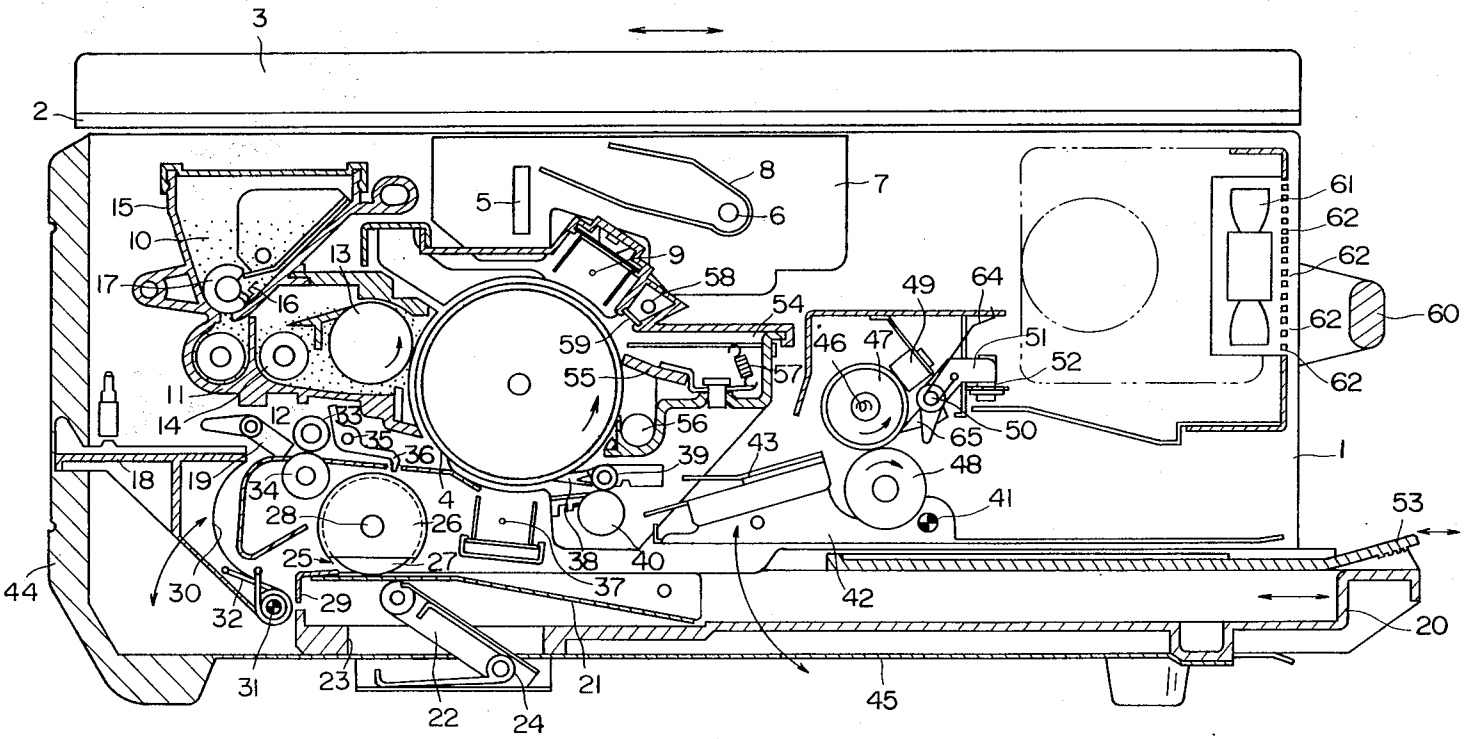
FIG. 1 is an elevational view in section of an electronic copier of a preferred embodiment of the image forming apparatus of the invention, illustrating the internal construction thereof, FIGS. 2(*a*), 2(*b*), 2(*c*), 3(*a*), 3(*b*), 3(*c*), 4(*a*), 4(*b*) and 4(*c*) are perspective views of a sensor of this invention which functions to sense not only the position of a recording paper but the position of the body of the apparatus of the invention.

Referring in detail to FIG. 1, the internal construction of an electronic copier of a preferred embodiment of the image forming apparatus of the invention is illustrated in elevation and section. The body 1 of the copier is formed as a case. An original support plate 2 is slidably mounted on the top of the body 1 and adapted to move right- or left-wardly in FIG. 1. A cover 3 is disposed over the original support plate 2 freely to close for supporting an original.

Reference numeral 4 designates a photosensitive drum cylindrically shaped and made of aluminum, the peripheral surface thereof being coated with a photosensitive agent such as polyvinyl carbazol. A row of lenses 5 each of short focus length for imaging on the peripheral surface of the photosensitive drum 4 is suspended above the uppermost position of the photosensitive drum 4. An exposure lamp (halogen lamp) 6 having a elliptical section reflecting mirror 8 is disposed at the rightward side of the row of short focus lenses 5 for illuminating the original placed on the original support plate 2. The row of short focus lenses 5 and the exposure lamp 6 are fixed to the same chassis 7. An electrifying corotron 9 is fixed up the paper passing route of the row of short focus lenses 5 for uniformly plus-electrifying (about 600 V) the photosensitive drum 4.

A developing means 11 is mounted down the paper passing route of the row of short focus lenses 5 for developing with toner an electromagnetic latent image formed on the photosensitive drum 4 by the electrifying corotron 9, the row of short focus lenses 5 and so forth. The developing means 11 comprises a manet roller 13 mounted rotatably to feed a developing agent 12 containing a mixture of toner and carrier toward the surface of the photosensitive drum 4 and a screw 14 mounted rotatably to mix the toner and the carrier. Reference numeral 15 designates a toner hopper integrally fixed to the developing means 11 and containing at the bottom thereof a screw 17 having a notch 16 for feeding the toner 10 stored in the hopper 15 to the developing means 11 little by little.

A hand-insertion paper ieeder 18 is disposed in the vicinity of the left side of the body 1 in FIG. 1. A start switch 19 operative as a sensor ior sensing jam of a copying paper as well as for starting is disposed down the paper passing route of the hand insertion paper feeder 18.

A paper feed cassette 20 is detachably mounted in the horizontal direction at the inner bottom of the body 1, and is adapted to be inserted leftwardly from the right side of the body 1 into the body 1 near the bottom. A support plate 21 is swingably disposed at the bottom of the paper feed cassette 20, on which a copying paper (not shown) in this apparatus as a copying paper is to be placed.

The paper feed cassette 20 is provided with an opening 23 at the bottom thereof so that the free end of a push up lever 22 elongates through the opening, the base end of said push up lever 22 being swingably attached to the inside of a protrusion at the bottom of the body 1. The push up lever 22 carries a torsion spring 24 acting on the push up lever 22 to rotate clockwise in FIG. 1, so that the support plate 21 is pushed up by the torsion spring 24.

A paper feed roller 26 made of high friction material is disposed above the vicinity of the front end of the paper passing route of the paper feed cassette 20, including a notch 25 partially cut away for feeding copying paper 5 one by one.

Reference numeral 27 designates an idler made of low friction material and mounted rotatably around the support shaft 28 of the paper feed roller 28 so that the notch 25 is prevented from coming in contact with a copying paper when the notch 25 is faced to the copying paper. Reference numeral 20 designates a corner separator for separating copying papers one by one. A guide 30 is disposed down the paper passing route of the paper feed cassette 20 for U-turning upwardly a copying paper fed through the paper feed roller 2G. The guide 30 integrated with the paper feeder 18 and having the lower end thereof inserted through a support shaft 31 is adapted to turn counterclockwise in FIG. 1 around the support shaft 31 as a supporting point. Reference numeral 32 designates a torsion spring which acts on the guide 30 clockwise in FIG. 1.

A pair of register rollers 33, 34 are disposed down the paper passing route of the guide 30 for feeding a copying paper supplied by the paper feed cassette 20 or the hand-insertion paper feeder 18 in synchronism with the movement of the original support plate 2. Of the pair of register rollers 33, 34, the lower roller 34 is connected to a driving source (not shown) and operative to rotate continuously. The pair of register rollers 33, 34 are lightly pressed so as to be kept in contact with each other for feeding a copying paper when the copying paper is not controlled with other means. Also, the pair of register rollers 33, 34 are constructed so that when other means controls a copying paper, the copying paper is slipped between the rollers 33, 34 to be prevented from passing by.

Down the paper passing route of the pair of register rollers 33, 34, a stopper 36 having the L-like shaped free end is mounted rotatably on a support shaft 35, the tip of the free end being operable to proceed across or recede from the paper passing route. When the tip of the stopper 36, proceeds across the paper passing route and a copying paper arrives, the front edge of the paper passing route of the copying paper is engaged with the tip of the stopper 36, so that further advancement of the copying paper is prevented. In this condition, a copying paper between the rollers 33, 34 is caused to slip. When the tip of the stopper 36 recedes timely from the paper passing route the copying paper which was temporarily ceased to advance begins to be fed again by the pair of register rollers 33, 34.

A transfer corotron 37 is disposed below the photosensitive drum 4 for transferring a toner image developed with the developing means 11 to a copying paper. A peeling claw 38 is provided adjacent to the photosensitive drum 4 down the paper passing route of the transfer corotron 37 for peeling off a copying paper from the photosensitive drum 4. The peeling claw 38 is mounted rotatably around a support shaft of the upper roller 39 of a pair of conveying rollers 39, 40 so that the tip of the peeling claw 38 is acted on to rotate into abutment against the surface of the photosensitive drum 4.

A paper feed guide 43 is fixed to a lever 42 mounted rotatably on a support shaft 41 down the paper passing route of the pair of conveying rollers 30, 40, and is constructed such that the paper feed guide 43 can be rotated counterclockwise in FIG. 1 around the support shaft 41 when the paper feed cassette 20 is drawn rightwardly out of the body 1 and the body 1 is raised conterclockwise in FIG. 1 to stand on an angular leg 44 mounted securely on the left side of the body 1 in FIG. 1. In this condition, the counterclockwise rotation of the paper feed guide 43 allows the rear end thereof in the paper passing route to be protruded out of the body 1 through an opening 45 at the bottom of the body 1, so that a jammed copying paper at the paper feed guide 43 can be removed.

A fixing means comprising a heat roller 47 having a halogen lamp with about 800 W inserted therein and a pressure roller 48 operable to come in contact with the heat roller 47 by pressure is disposed down the paper passing route of the paper feed guide 43.

A temperature sensor 49 made of silicone rubber and having a thermister located on the surface thereof is disposed on the rightupward side of the heat roller 47 in FIG. 1 so that the thermister can slide in contact with the surface of the heat roller 47 for sensing the temperature. Reference numeral 65 designates a peeling claw 65 to peel off a copying paper sticking to the surface of the heat roller 47.

Down the paper passing route of the fixing means, a C-like shaped lever 51 is rotatably mounted in the vertical plane of the body 1 in the normal operation, and further down the paper passing route, a photocoupler 52 is disposed so that the optical path can be selectively intercepted by the lever 51 which is supported rotatably around a support shaft 50 located at a lower position than the center of gravity thereof. When the lever 51 rotates, the upper portion thereof (the same side of the support shaft 50 as the center of gravity) is allowed to intercept the optical path of the photocoupler 52 while the lower portion thereof (the opposite side of the support shaft 50 to the center of gravity) to cross the paper passing route. The lever 51 is acted on by a torsion spring 64 so that the lower portion is directed into opposition to the paper passage.

In the normal use condition of the body 1, that is, when the body 1 takes a position for normal use and a copying paper is not present at the lever 51, the lever 51 is kept stationary in such a portion that the upper portion intercepts the optical path of the photocouple 52 (in this condition, the lower portion crosses the paper passing route). When the copying paper further moves down the paper passing route of the fixing means, the front end thereof comes in contact with the lower portion of the lever 51 to cause the lever 51 to turn counterclockwise in FIG. 1. Then the optical path of the photocoupler 52 is released from the intercepted state. When the copying paper further advances, the lower portion of the lever 51 is caused to rotate from the point where the lower portion crosses the paper passing route to the point where the lower portion is in contact with the paper passing route, so that the copying paper passes by and moves down the paper passing route.

The photocoupler 52 functions as a sensor for sensing the posture of the body 1. The interception of the optical path of the photocoupler 52 by the lever 51 indicates that the body 1 takes a posture for normal use and a copying paper is not present at the lever 51. The photocoupler 52 is connected to a microcomputer (not shown) through a control circuit (not shown). The apparatus of this invention is constructed such that unless the lever 51 intercepts the optical path of the photocoupler 52 in the operation stand by state of the apparatus, the apparatus does not operate even by inputting the copy start switch.

The copying paper of which the toner image has been fixed by the fixing means is discharged in a receiving tray 53 disposed at the upward side of the paper feed cassette 20. The paper receiving tray 53 is movable laterally of the body 1 to project out of or retract into the body 1, and when not necessitated, is inserted into the body 1.

A cleaning means 54 is disposed down the paper passing route of the peeling claw 38 (upward in FIG. 1) in the rotation direction of the photosensitive drum 4 for removing residual toner on the photosensitive drum 4 which has not been transferred to the copying paper. The cleaning means 54 contains a rubber blade 55 to scrape off the residual toner on the photosensitive drum 4 and a screw conveyor 56 for discharging the scraped toner. The blade 55 is provided with a spring 57 which biases the blade 55 counterclockwise, that is, which acts on the blade 55 to direct the tip thereof toward the photosensitive drum 4. An erase lamp 58 is disposed at the forward side of the cleaning means 54 along the rotation direction of the photosensitive drum 4 (upward in FIG. 4) for removing substantially all electric charges on the photosensitive drum 4. Reference numeral 59 designates a filter of the erase lamp 58.

A handle 60 adaptable ior use in raising or lifting the body 1 is fixed on the right side of the body 1 in FIG. 1, that is, on the opposite side to that on which the angular leg 44 is fixed. A cooling fan shown at 61 is disposed on the inward side of the wall to which the handle 60 is fixed, for exhausting the air out of the body 1 through a plurality of ventilating holes 62 provided by perforating the wall. The body 1 can be raised as described above without reduction in the ventilation efficiency, since the cooling fan 61 located in such position is not faced to the floor and the like while the cooling fan 61 is being rotated to exhaust the air.

When the copy start switch is operated aiter placement of an original on the original support plate 2, the original support plate 2 moves rightwardly in FIG. 1 and then moves back leftwardly. In the reciprocation of the original support plate 2, the original image is projected on the photosensitive drum 4 to form the electrostatic latent image corresponding to the original image. Thereafter, the electrostatic latent image is developed with toner in the developing means 11. The toner image is transferred by a transfer corotron 37 to a copying paper fed from the paper feed cassette 20. The copying paper which is transferred the toner image is peeled off by a peeling claw 38 from the photosensitive drum 4, iixed by application of heat-pressure in the fixing means, and then discharged into the receiving tray 53.

The residual electric charges and toner on the photosensitive drum 4 untransferred to the copying paper are removed by the erase lamp 58 and the cleaning means 54.

Figure 2A:
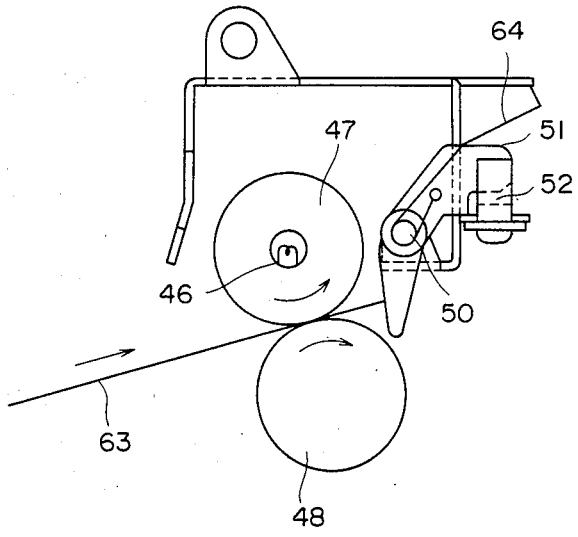
Figure 2B:
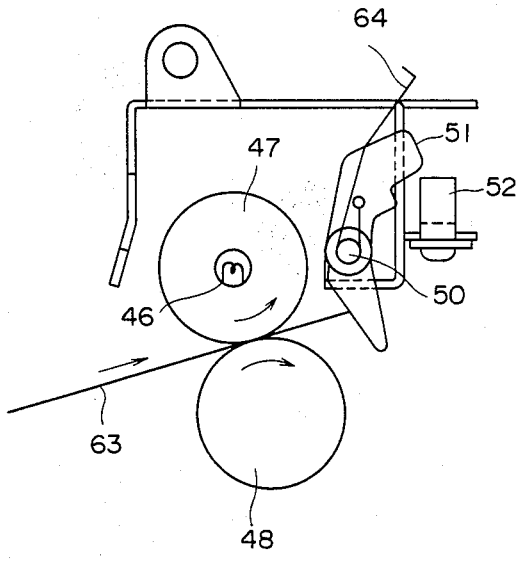
Figure 2C:
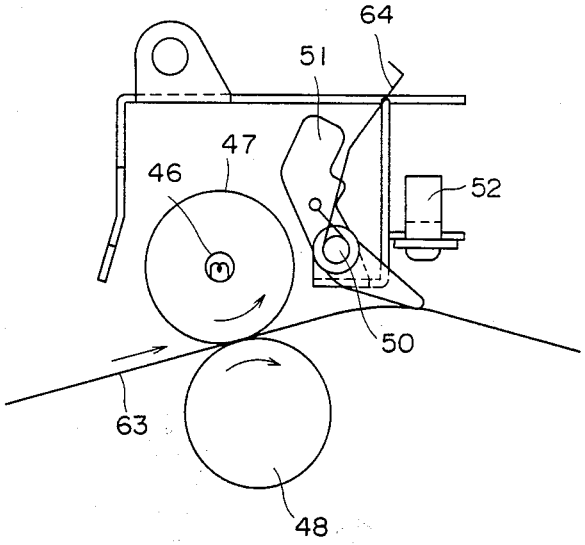
Figure 3:
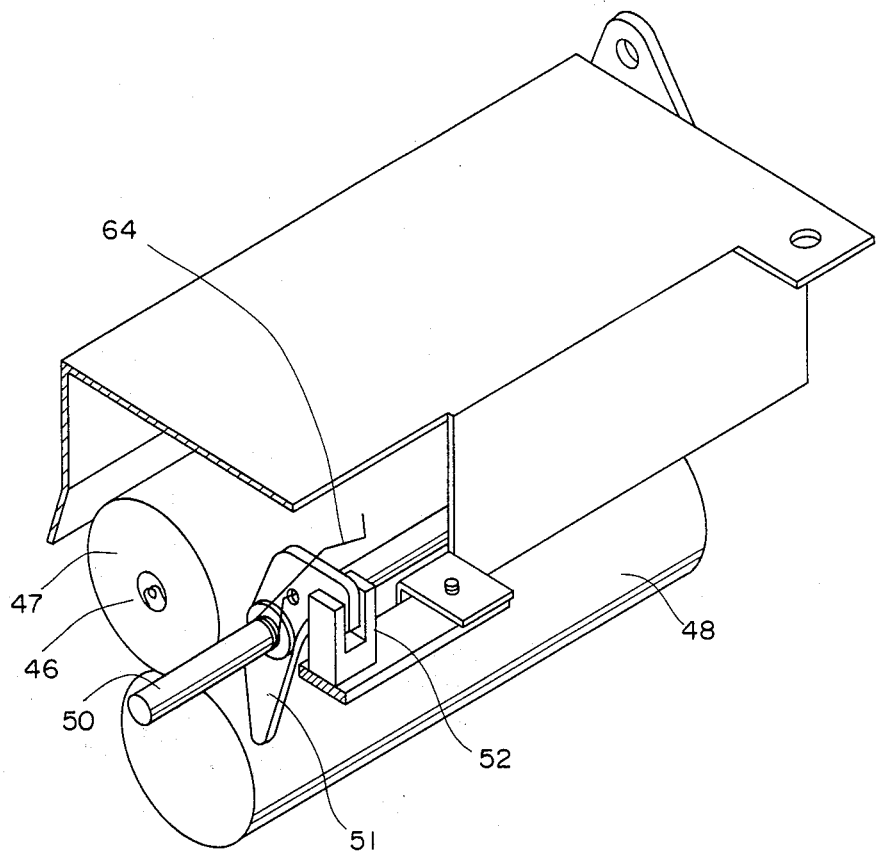
Figure 3B:
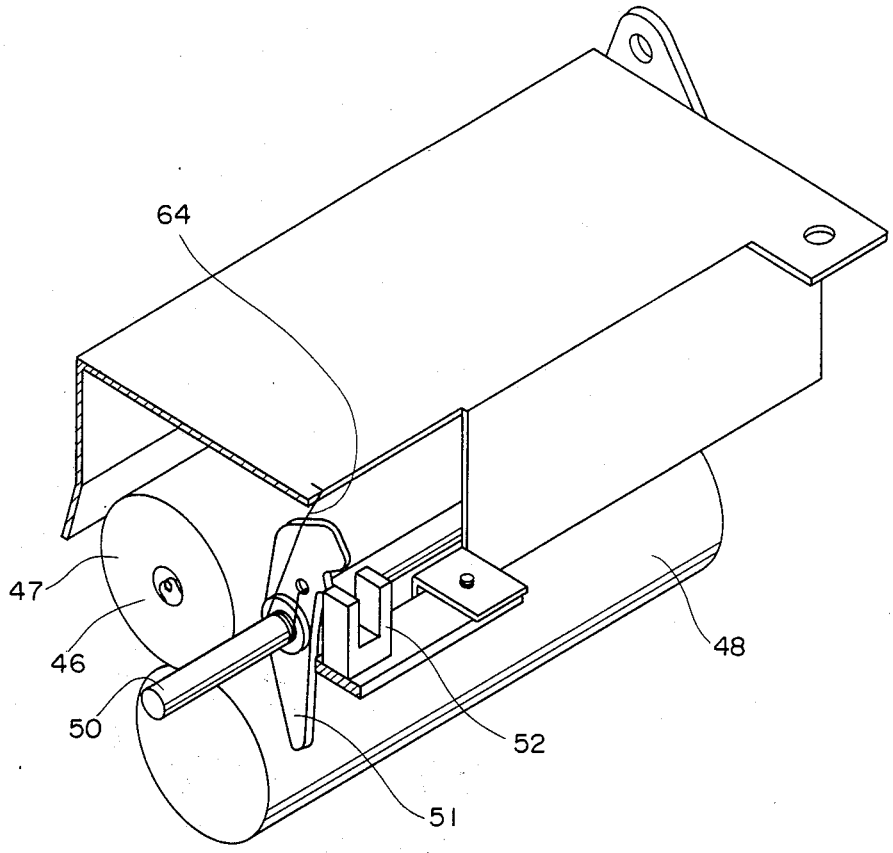
Figure 3C:
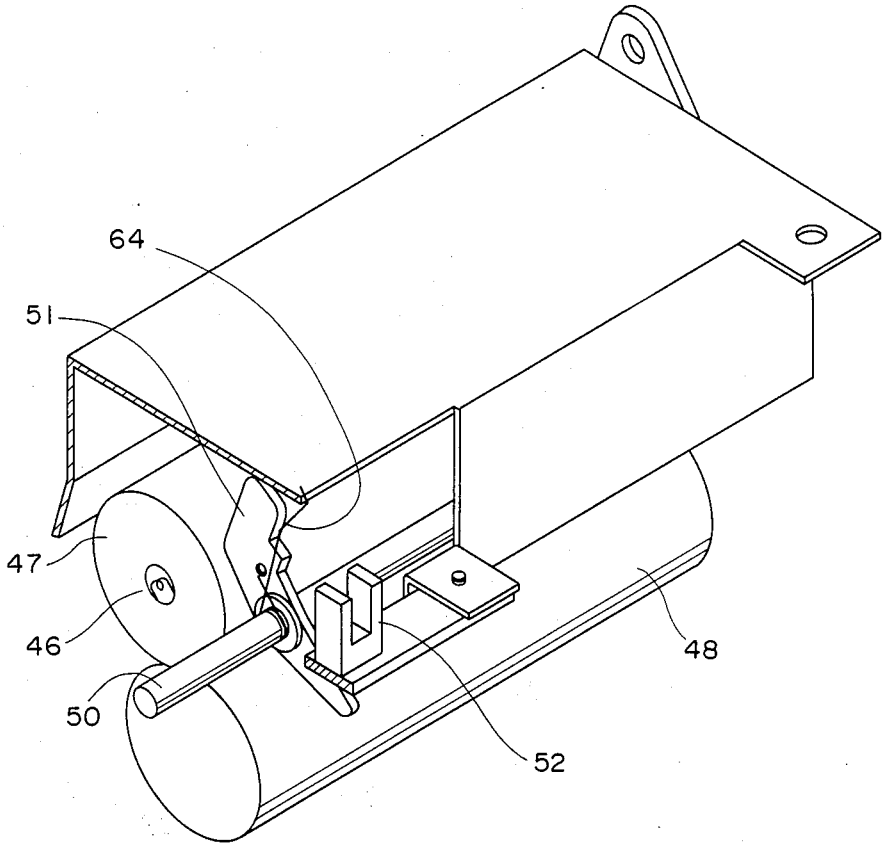
Figure 4:
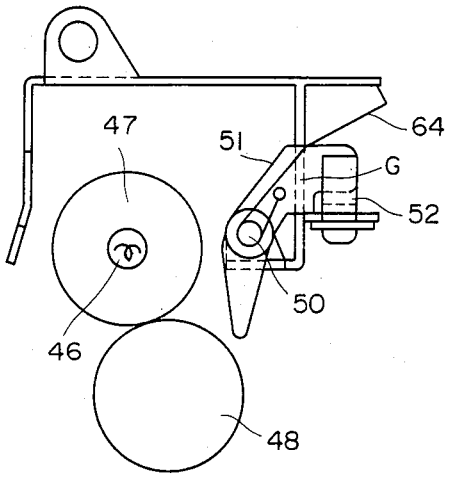
Figure 4:
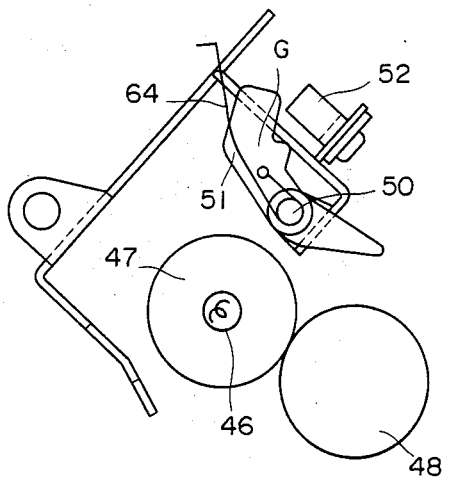
Figure 4:
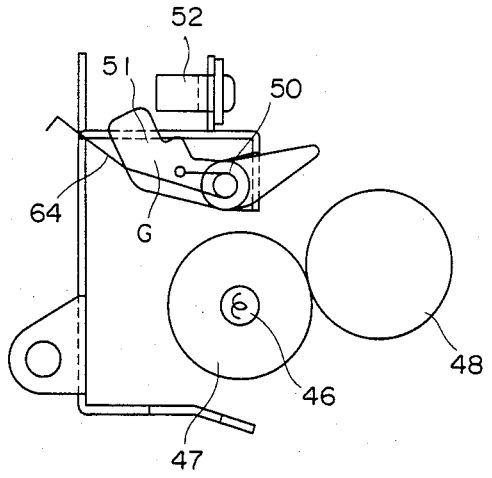

Referring to operation of the C-like shaped lever 51 and the photocoupler 52 shown in FIGS. 2 through 4, the presence of a copying paper 63 after fixation by the heat roller 47 and pressure roller 48 is sensed by the contact of the copying paper with the lever 51 perspectively viewed in FIGS. 2(*a*), (*b*), (*c*). First, when the front edge of the copying paper 63 comes in contact with the lower portion of the lever 51, the lower portion of the lever 51 is caused to rotate counterclockwise in FIG. 1 around the support shait 50 as a supporting point. At the same time the optical path of the photocoupler 52 is released from the interception by the upper portion of the lever 51. The photocoupler 52 signals a microcomputer (not shown) that the copying paper 63 has arrived. The torsion spring 64 acting on the lever 51 to rotate clockwise in FIG. 1 is low in moment, and is provided for restoring the lever 51 to a predetermined position (at which the upper portion of the lever 61 intercepts the optical path) of the photocoupler 52 after the copying paper 63 passing by.

Referring to the operation of the lever 51 as illustrated in FIGS. 4(*a*), (*b*), (*c*) when the body 1 is raised counterclockwise to an angle of 90 degrees to the horizontal position, the position o lever 51 when the body 1 is in position for normal use is illustrated in FIG. 4(*a*), and the position of the lever 51 when the body 1 stands upright after being raised to a right angle to the horizontal position in FIG. 4(*c*). The intermediate position of the lever 51 is illustrated in FIG. 4(*b*).

As seen in these drawings, when the body 1 is raised counterclockwise in FIG. 1 as described above, the lever 51 begins to rotate counterclockwise in FIG. 4 by its own weight, due to the center of gravity G of the lever 51 positioned higher than the center of the support shaft 50 as the rotation center of the lever 51, against the weak action of the torsion spring 64 relatively to some extent to the movement of the body 1 after the center of gravity G crosses the vertical line passing through the rotation center. Since the optical path of the photocoupler 52 is released from the interception thereby, the copier does not start the copying operation even by operating the copy start switch as well as in the copy stand by state as stated above. Therefore, when the body 1 is raised to an angle of 90 degrees to the horizontal position of the body 1 in the normal operation for removing a jammed copying paper, the copying operation does not start even by touching and operating the copy start switch accidently by fingers and the like.

Figure 5:
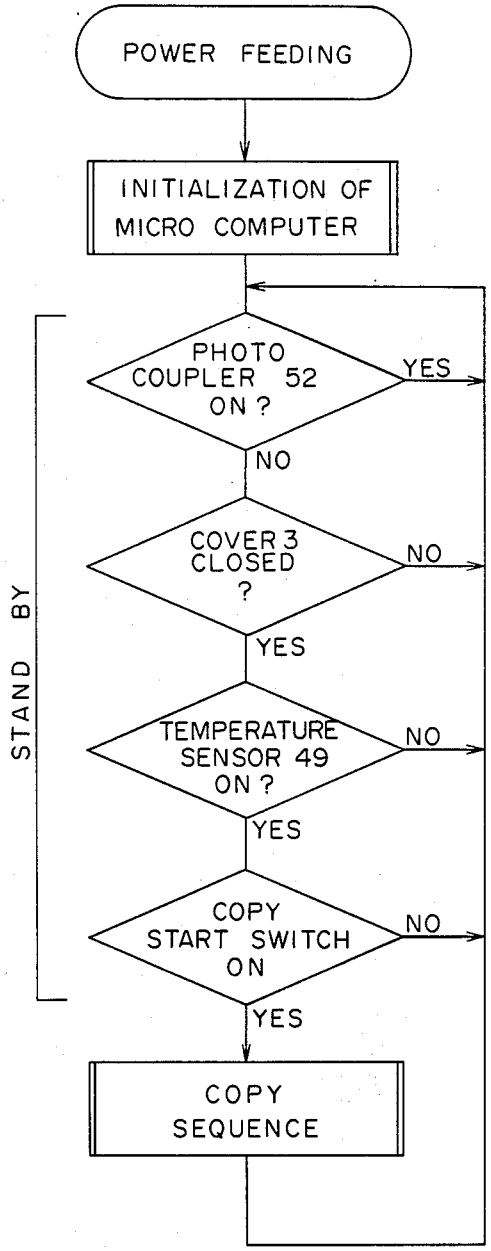
FIG. 5 is a flow chart showing the controlling contents of a microcomputer of the apparatus of the invention.

In this embodiment, the apparatuis is controlled by a microcomputer as illuastrated by the flow chart in FIG. 5. The microcomputer is first powered and, after setting the various initial conditions, enters the stand by state. In this stand by state, when the microcomputer checks sequentially the ON or OFF condition of the photocoupler 52, the CLOSE or OPEN condition of the cover 3 of the original support plate 2, the ON or OFF condition of the temperature sensor 49 provided at the heat roller 47, and the ON or OFF condition of the copy start switch (not shown).

When the body 1 is in a posture different from that of the body 1 in the normal operation e.g., the body 1 is raised to an angle of 90 degrees to the horizontal position for removing a jammed paper and so forth, the optical path of the photocoupler 52 is released from the interception to be in ON condition, so that the copying operation does not start even by operating the copy start switch 4.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore to be embraced by the claims.

What is claimed is:

1. An image forming apparatus comprising a body part having an operating posture during normal image forming operation and being movable to a second different posture, means defining a paper passing route, sensing means for sensing the posture of the body, at least part of said sensing means being interposed in the paper passing route, so that said sensing means also senses whether paper is within said paper passing route proximate to said sensing means, means for stopping the image forming operation when said sensing means senses that said body is in the second posture.

2. An image forming apparatus comprising a body part having an operating posture during normal image forming operation, a sensing means for sensing the posture of the body comprising a lever pivoted rotatably at a point different from its center of gravity and a sensor for sensing a rotational position of said lever during normal image forming operation, said lever being rotated by gravity relative to said body part to a rotational position at which said sensor does not sense when said body is in a posture different from the posture during normal image forming operation.

3. An image forming apparatuss set forth in claim 1, wherein said body is provided with a handle on one side thereof in the normal image forming operation.

4. An image forming apparatus as set forth in claim 2, wherein said body is provided with a handle on one side thereof in the normal image forming operation.

5. An image forming apparatus as set forth in claim 1, wherein said body is provided with an original support plate at the top thereof in the normal image forming operation, said original support plate carrying an original and moving in the lateral direction of said body.

6. An image forming apparatus according to claim 1 additionally comprising a second means for selectively stopping the image forming operation when the sensing means senses that paper is stationary within said paper passing route proximate to said sensing means.

7. An image forming apparatus according to claim 1 wherein the sensing means comprises a rotating lever and a sensor for sensing a rotational position of said lever, said lever being rotated during normal image forming operation from a first rotational position to a second rotational position by paper moving through the paper passing route.

8. An image forming apparatus according to claim 1 wherein the sensing means comprises a lever pivoted rotatably at a point different from its center of gravity, said lever being rotated from a first rotational position to a second rotational position by at least one of gravity relative to said body part and paper passing through the paper passing route proximate to said sensing means, and a sensor for sensing at least one of said first and second rotational positions.

9. An image forming apparatus according to claim 1 wherein the sensing means comprises a lever pivoted rotatably at a point different from its center of gravity, said lever being rotated by gravity relative to said body part, and a sensor for sensing at least one of a first rotational position of said lever corresponding to the operational posture of said body part and a second rotational position of said lever corresponding to the second position of said body part.

10. An image forming apparatus according to claim 2 wherein the sensor comprises a photocoupler having an optical path selectively intercepted by at least a portion of said lever.

11. An image forming apparatus according to claim 7 wherein the sensor comprises a photocoupler having an optical path selectively interrupted by at least a portion of said lever.

12. An image forming apparatus according to claim 8 wherein the sensor comprises a photocoupler having an optical path selectively interrupted by at least a portion of said lever.

13. An image forming apparatus comprising a body part having an operating posture during normal image forming operation and being movable to a second different posture, means defining a paper passing route, sensing means, at least a portion of which is interposed in the paper passing route and comprising a lever pivoted rotatably at a point different from its center of gravity, and a sensor for sensing a first rotational position of said lever corresponding to the operational posture of the body, said lever being rotated by gravity relative to said body to a second rotational position when the body is in the second posture, the lever also being rotated during normal image forming operation from a first rotational position to a second rotational position as a result of contact between said interposed sensing means and paper moving through the paper passing route, and means for stopping the image forming operation when the sensing means senses at least one of said body being in the second posture and that paper in the paper passing route has achieved at least one predetermined posture proximate to said sensing means.

14. An image forming apparatus according to claim 13 wherein said lever has a C-like shape and is provided with a torsion spring, the sensor comprises a photocoupler having an optical path selectively and reversibly intercepted by at least a portion of said lever, and the means for stopping the image forming operation comprises a microprocessor-controlled sampling a switching circuit acting in predetermined cooperating with the lever and the photocoupler.

* * * * *